US011502443B2

(12) United States Patent
Fan et al.

(10) Patent No.: US 11,502,443 B2
(45) Date of Patent: Nov. 15, 2022

(54) TERMINAL HOLDER AND CONNECTOR

(71) Applicant: YAZAKI (CHINA) INVESTMENT CORPORATION, Shanghai (CN)

(72) Inventors: Lijuan Fan, Shanghai (CN); Haijun Chen, Shanghai (CN); Xuehua Gu, Shanghai (CN)

(73) Assignee: YAZAKI (CHINA) INVESTMENT CORPORATION, Shanghai (CN)

( * ) Notice: Subject to any disclaimer, the term of this patent is extended or adjusted under 35 U.S.C. 154(b) by 0 days.

(21) Appl. No.: 17/285,130

(22) PCT Filed: Jun. 19, 2019

(86) PCT No.: PCT/CN2019/091869
§ 371 (c)(1),
(2) Date: Apr. 14, 2021

(87) PCT Pub. No.: WO2020/078028
PCT Pub. Date: Apr. 23, 2020

(65) Prior Publication Data

US 2021/0351537 A1 Nov. 11, 2021

(30) Foreign Application Priority Data

Oct. 19, 2018 (CN) ..... 201821700458.8

(51) Int. Cl.
*H01R 13/426* (2006.01)
*H01R 13/422* (2006.01)

(52) U.S. Cl.
CPC ..... *H01R 13/426* (2013.01); *H01R 13/4223* (2013.01)

(58) Field of Classification Search
CPC .. H01R 13/42; H01R 13/422; H01R 13/4223; H01R 13/424; H01R 13/426; H01R 13/50
(Continued)

(56) References Cited

U.S. PATENT DOCUMENTS 4,932,899 A 6/1990 Sueyoshi et al.
4,984,998 A 1/1991 Duncan et al.
(Continued)

FOREIGN PATENT DOCUMENTS

CN 1244056 A 2/2000
WO 2020/078028 A1 4/2020

OTHER PUBLICATIONS

International Search Report and Written Opinion of the International Search Report for PCT/CN2019/091869 dated Sep. 2, 2019.

*Primary Examiner* — Marcus E Harcum
(74) *Attorney, Agent, or Firm* — Kenealy Vaidya LLP

(57) ABSTRACT

A terminal holder to be inserted into a connector housing and a connector including the terminal holder is disclosed. The terminal holder can include a pair of locking arms facing each other, a coupling arm connecting one of the ends of the pair of locking arms opposite each other, and a supporting arm connecting inner surfaces of the pair of locking arms facing each other, wherein a locking portion is provided on an outer surface of each of the pair of locking arms opposite to the inner surface. In accordance with an aspect of an embodiment of the terminal holder of present disclosure, the insertion force for inserting the terminal holder can be effectively reduced, the breakage of the terminal holder in the insertion process can be suppressed, and the terminal retention force for holding the terminal and the retaining force between the terminal holder and the connector housing can be improved.

14 Claims, 5 Drawing Sheets

(58) Field of Classification Search
USPC ..... 439/352, 351, 353, 540.1, 595, 752
See application file for complete search history.

(56) References Cited

U.S. PATENT DOCUMENTS 5,120,269 A * 6/1992 Endo ..... H01R 13/4368 439/752
5,160,279 A 11/1992 Sagawa et al.
5,322,457 A * 6/1994 Tsuji ..... H01R 13/4368 439/752
5,628,648 A * 5/1997 Higgins, Jr. ..... H01R 13/641 439/372
5,679,024 A 10/1997 Seki
5,746,624 A * 5/1998 Ohsumi ..... H01R 13/6315 439/595
5,910,027 A * 6/1999 Wayt ..... H01R 13/6272 439/352
5,964,603 A * 10/1999 Hanazaki ..... H01R 13/62905 439/157
6,045,412 A * 4/2000 Guanco ..... H01R 13/4361 439/752
6,048,226 A * 4/2000 Iwahori ..... H01R 13/4364 439/751
6,468,115 B2 * 10/2002 Kashiyama ..... H01R 13/4367 439/752
6,780,045 B2 * 8/2004 Shuey ..... H01R 13/641 439/352
6,896,538 B2 * 5/2005 Grubbs ..... H01R 13/6272 439/352
6,939,159 B1 * 9/2005 Klein ..... H01R 13/641 439/378
7,396,253 B2 * 7/2008 Nakamura ..... H01R 13/641 439/352
7,470,138 B1 * 12/2008 Chen ..... H01R 13/639 439/352
7,909,638 B2 * 3/2011 Seo ..... H01R 13/6272 439/352
8,016,606 B1 * 9/2011 Kwan ..... H01R 13/641 439/352
8,550,860 B2 * 10/2013 Dick ..... H01R 13/4365 439/752
9,246,255 B1 * 1/2016 Holthus ..... H01R 13/4364
9,246,268 B1 1/2016 Richardson et al.
2001/0006861 A1 * 7/2001 Ohsumi ..... H01R 13/4223 439/752
2001/0027058 A1 10/2001 Pederson et al.
2004/0248453 A1 * 12/2004 McLauchlan ..... H01R 13/6272 439/352
2009/0035981 A1 * 2/2009 Lim ..... H01R 13/4361 439/352
2016/0181727 A1 * 6/2016 Kato ..... H01R 13/502 439/310
2017/0250492 A1 * 8/2017 Endo ..... H01R 13/426

* cited by examiner

TERMINAL HOLDER AND CONNECTOR

This application is a U.S. National Stage Application under 35 U.S.C. § 371 of International Patent Application No. PCT/CN2019/091869 filed Jun. 19, 2019, which claims the benefit of priority to Chinese Patent Application No. 2018-21700458.8 filed Oct. 19, 2018, the disclosures of all of which are hereby incorporated by reference in their entireties.

TECHNICAL FIELD

The present disclosure relates to a terminal holder and a connector having the terminal holder with which it is possible to effectively reduce the insertion force for insertion of the terminal holder, and to suppress breakage of the terminal holder during insertion while enhancing the strength of the terminal holder, and to improve the terminal retention force for holding the terminal and the retaining force of the terminal holder and a connector housing.

BACKGROUND

Traditionally, due to different designs or the like, it may be desirable to insert different terminals in the connector housing to facilitate subsequent electrical requirements, and thus, the conventional practice is to transport the connector housing to a site for insertion of the terminals after the connector housing is prepared, instead of immediately performing the insertion work of the terminals on the spot where the connector housing is prepared, thereby performing the insertion work of the terminals in accordance with the personalized requirements.

In order to ensure that the terminal is prevented from falling off from the connector housing when the terminal is fully inserted into the connector housing, it is usually necessary to double-lock the terminal. Thus, it is considered to mount a terminal holder to the connector housing before the connector housing is transported, so that the terminal holder can be stably installed in the connector housing during transport of the connector housing without falling off due to vibration or the like. Further, the installation of the terminal holder should not affect the subsequent insertion operation of the terminal, and thus making it possible to achieve the double locking of the terminal by simply continuing the insertion of the terminal holder after the insertion of the terminal is finished.

Due to above circumstances, it is necessary to consider to design a terminal holder which can effectively reduce the insertion force for insertion of the terminal holder, suppress breakage of the terminal holder during insertion while enhancing the strength of the terminal holder, and improve the terminal retention force for holding the terminal and the retaining force of the terminal holder and the connector housing.

In view of this, a terminal holder and a connector including the terminal holder of the present disclosure are proposed.

SUMMARY OF DISCLOSURE

A first aspect of the present disclosure provides a terminal holder to be inserted into a connector housing, characterized in that the terminal holder comprising:

a pair of locking arms facing each other;

a coupling arm connecting one ends of the pair of locking arms opposite to each other; and a supporting arm connecting inner surfaces of the pair of locking arms facing each other, wherein a locking portion is provided on an outer surface of each of the pair of locking arms opposite to the inner surface.

According to the terminal holder of the first aspect, the inner surfaces of the pair of locking arms facing each other are connected to each other by the supporting arm, so that it is able to improve the strength and rigidity of the terminal holder. The pair of locking arms each includes the locking portion disposed on the outer surface, so that the terminal holder is suppressed from being loosened and falling after the terminal holder is installed on the connector housing and also the switching between two locking positions of the terminal holder is achieved.

The locking portion of the terminal holder in the first aspect can include a first locking portion and a second locking portion that are protruded from the outer surface and are separately provided from each other, the first locking portion is arranged on a side of the other end of the locking arm and the second locking portion is arranged on a side of the coupling arm with respect to the first locking portions.

With the arrangement described above, by simply arranging the first locking portion and the second locking portion as the locking portion, it is possible to restrict the terminal holder from being loosened and falling after the terminal holder is installed on the connector housing and also to achieve the switching between the two locking positions of the terminal holder.

The supporting arm of the terminal holder of the first aspect can include an elastic portion with which the pair of locking arms is movable in a direction close to each other and in a direction away from each other.

In this aspect, since the supporting arm of the terminal holder comprises an elastic portion with which the pair of locking arms is movable in a direction close to each other and away from each other, even if the two locking arms are pressed in the insertion process of the terminal holder to the connector housing, it is possible to absorb the pressing force by the elastic portion, thereby suppressing unexpected breakage of the supporting arm of the terminal holder due to the large pressing force, and since the locking arms can easily move close to each other due to the fact that the pressing force is easily absorbed by the elastic portion, the insertion force of the terminal holder can also be reduced, and the degree of freedom of material selection can be improved by utilizing the advantages of the structure itself, without being limited to materials with very high requirements on both compression and resilience.

The elastic portion can be one of an S-shaped portion, a wavy portion and an arc portion formed in the supporting arm.

In this aspect, the aforementioned elastic portion is one of an S-shaped portion, a wavy portion and an arc portion formed in the supporting arm, and wherein the S-shaped portion is most preferred. The manufacturing process is simple and the molding is easy by means of above shapes, especially when the elastic portion is the S-shaped, since the two ends of the elastic portion are connected to the inner surfaces of the locking arms at different positions, the space between the two locking arms can be utilized uttermost, the length of the supporting arm is lengthened, the strength of the terminal holder can be effectively improved, and the elastic deformation performance for absorbing the pressing force is excellent.

The first locking portions can be provided at the other end of the pair of locking arms, respectively. This facilitates shortening the overall length of the terminal holder to have a miniaturized design, and the switching of the two locking positions is easily accomplished without affecting the effects of the two locking positions.

The supporting arm can be positioned between the first locking portions and the second locking portions. According to the structure, the supporting arm can effectively apply supporting force to the position between the first locking portion and the second locking portion, which helps to achieve the balance of acting force and is beneficial for improving the retaining force and supporting force.

The coupling arm of the terminal holder can be arc-shaped, and a pair of tabs projecting outwardly is formed on an outer surface of the coupling arm.

In this aspect, the arc-shaped coupling arm has flexibility, so as to facilitate elastically deformation due to the pressing force when inserting the terminal holder, further facilitate smooth insertion of the terminal holder, and also to ensure the mounting direction of the terminal holder by the pair of tabs disposed at the outside surface of the coupling arm in a manner of projecting outwardly, so that the terminal holder is not installed obliquely.

A second aspect of the present disclosure provides a connector characterized in comprising:

a connector housing;

a terminal; and the aforementioned terminal holder, wherein the connector housing comprises a terminal accommodating chamber in which the terminal is inserted and received, and the terminal holder is also inserted in the terminal accommodating chamber, a lance in a form of a cantilever overhung toward an opening of the terminal accommodating chamber for inserting the terminal holder is provided on an inner wall surface of an upper wall on an upper side of the terminal accommodating chamber of the connector housing, and mating locking portions are provided on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at the free end of the lance is retained into the retaining hole so that the terminal is locked to the connector housing, and the terminal holder is inserted into a space between the inner wall surface of the upper wall of the terminal accommodating chamber of the connector housing and the lance and can be locked in the space by a locking between the locking portions and the mating locking portions, and the terminal holder has a temporary locking position at which the terminal is not inserted to a final position and the lance is elastically deformable and a final locking position at which the terminal is at the final position, the retaining projection of the lance is retained in the retaining hole, and the terminal holder interferes with the lance, so that the lance cannot be elastically deformed in a direction of disengaging from the retaining hole.

The connector according to the second aspect can achieve the technical effects of the terminal holder in the first aspect. Additionally, at the temporary locking position of the terminal holder, the terminal is not inserted into the final position and the lance is elastically deformable. Therefore, it may be ensured that, during transport, the terminal holder is locked in the temporary locking position without being loosened or falling from the connector housing due to vibration or the like, and after transport, the required terminals can be inserted according to the personalized needs of the user to meet the desired electrical requirements. The terminal holder can be further inserted so as to be positioned at the final locking position when the terminal is mounted on the final position. At this time, since the terminal holder interferes with the lance, the lance cannot be elastically deformed, that is, it cannot be withdrawn from the retaining hole of the terminal, thereby achieving double locking of the terminal by the lance and terminal holder.

In the connector of the second aspect, the mating locking portions can be formed on the inner wall surfaces of the side walls on the left and right sides of the terminal accommodating chamber of the connector housing opposite to each other are locking protrusions protruding towards the inside of the terminal accommodating chamber, the locking protrusions are retained between the first locking portions and the second locking portions of the terminal holder at the temporary locking position of the terminal holder, and the locking protrusions are retained to the second locking portions at the final locking position of the terminal holder.

In present application, the switching between the temporary locking position and the final locking position of the terminal holder is achieved with a simple structure by the corresponding retaining relationship between the locking protrusions provided on the inner wall surfaces of the side walls on the left and right sides of the terminal accommodating chamber and the first locking portions and the second locking portions on the outside surface of the locking arms of the terminal holder.

BRIEF DESCRIPTION OF DRAWINGS

FIG. 2 is a view illustrating a terminal according to an embodiment of the present disclosure, wherein

FIG. 3 is a view showing that the terminal holder is inserted in the terminal accommodating chamber of the connector housing according to the embodiment of the present disclosure, and showing a state that the terminal holder is at the temporary locked position, wherein

FIG. 5 is a view showing that the terminal holder is inserted in the terminal accommodating chamber of the connector housing according to the embodiment of the present disclosure, and showing a state that the terminal holder is at the final locked position, wherein

DESCRIPTION OF EMBODIMENTS

A more thorough understanding of the technical solution and the technical effect of the present disclosure will be made by describing the embodiments of present disclosure in detail with reference to the accompanying drawings below.

Figure 3A:
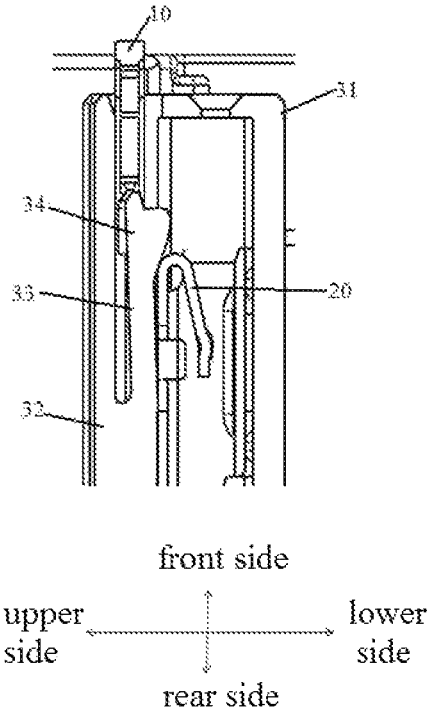
FIG. 3A shows a side view in a longitudinally sectioned state.
Figure 3B:
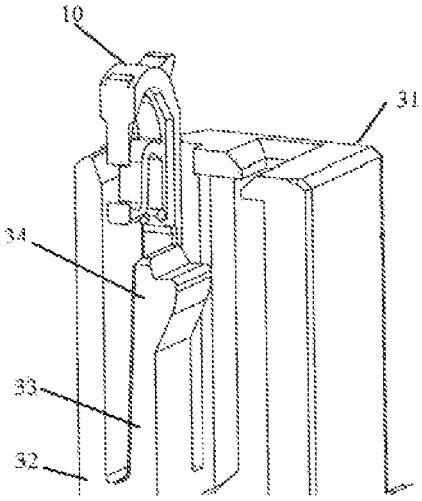
FIG. 3B is a perspective view of FIG. 3A in which the terminal is omitted.
Figure 4:
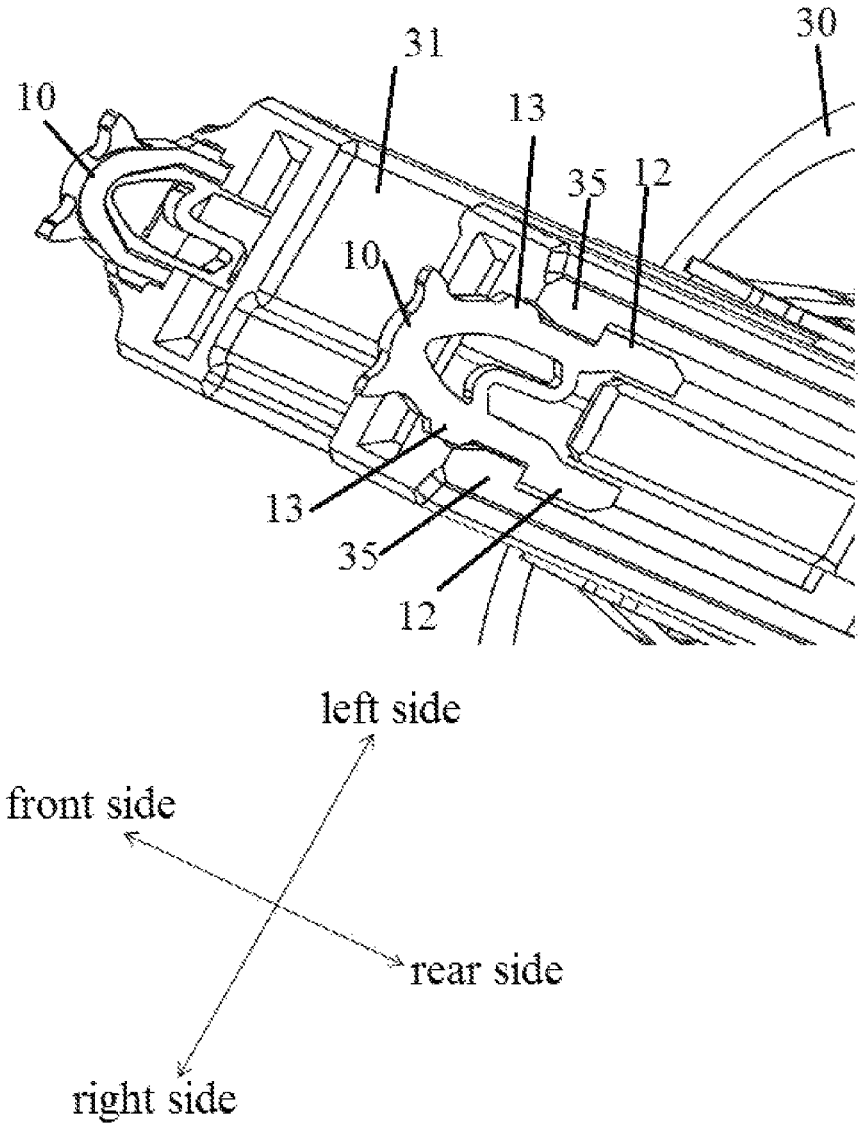
FIG. 4 is a cross-sectional perspective view of the state shown in FIG. 3 when viewing an interior of the terminal accommodating chamber from a direction perpendicular to a plane of the terminal holder.

In the following description, for convenience, as shown in FIGS. 3 and 4, a side of an electrical connection portion of the terminal is regarded as a front side of a front-rear direction of the terminal, a side of a crimping portion side of the terminal is regarded as a rear side of the front-rear direction of the terminal, a side at which a lance is formed is regarded as an upper side of a vertical direction of the terminal, a side opposite to the upper side is regarded as a lower side in the vertical direction, a direction perpendicular to both the front-rear direction and the vertical direction is regarded as a left-right direction.

At first, a terminal holder 10 according to the present disclosure will be described with reference to FIG. 1. As is shown in FIG. 1, the terminal holder 10 includes a pair of locking arms 11, 11 facing each other, a coupling arm 15 that connects one ends of the pair of locking arms 11, 11 facing to each other, and a supporting arm 14 that connects inner side surfaces of the pair of locking arms 11, 11 facing to each other.

As an example of locking portion, first locking portions 12 and second locking portions 13 are provided on an outer surface of each of the pair of locking arms 11, 11 opposite to the inner surface. The first locking portions 12 and the second locking portions 13 are provided to protrude from the outer surface and are provided separately from each other. The first locking portion 12 is disposed on a side of the other end of each locking arm 11, and the second locking portion 13 is disposed on the side of the coupling arm 15 with respect to the first locking portions 12. The first locking portions 12 can be located at the other ends of the pair of locking arms 11, 11, respectively, which is beneficial to shorten the overall length of the terminal holder 10, have a miniaturization design, and easily achieve the temporary locking position and the final locking position described later. Also, the position of the supporting arm 14 can be located between the position of the first locking portions 12 and the position of the second locking portions 13, so that according to such a configuration, the supporting arm can provide a supporting force to the position between the first locking portions and the second locking portions effectively, and thereby achieving a balance of the force and enhancing a retaining force and a supporting force for a connector housing.

Figure 1:
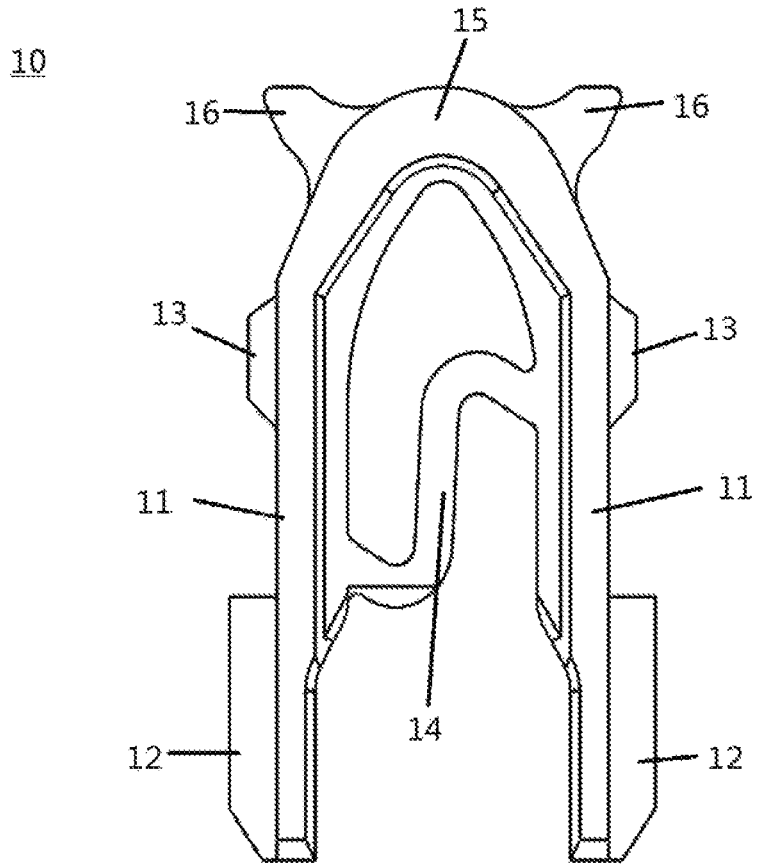
FIG. 1 is a plan view illustrating a terminal holder according to an embodiment of the present disclosure.

In the present embodiment, as shown in FIG. 1, the supporting arm 14 may include an S-shaped elastic portion with which the pair of locking arms 11, 11 can move in a direction close to each other and in a direction away from each other. In other words, the supporting arm 14 is able to be elastically deformed by including the S-shaped elastic portion, thereby a pressing force acting on the locking arms 11, 11 could be absorbed, and also, the supporting arm 14 is able to be elastically restored.

Here, the S-shape of the elastic portion shown in FIG. 1 is just an example and is not a limitation, and the elastic portion may be formed into any other shapes, for example, wave-shaped, circular arc-shaped, and the like, as long as it can be easy to deform elastically so as to absorb the pressing force acting on the locking arms 11, 11 and can be elastically restored.

In present embodiment, since the two ends of the supporting arm 14 are connected to the inner surfaces of the locking arms 11, 11 at different positions respectively as shown in FIG. 1 when the S-shaped elastic portion is selected, the space between the two locking arms 11 and 11 can be utilized to the greatest degree, thereby lengthening the length of the supporting arm 14, enhancing the strength of the terminal holder 10 more effectively, improving the ability of elastic deformation in absorbing the pressing force, and increasing the supporting force. Therefore, the S-shaped elastic portion is preferable.

As shown in FIG. 1, the coupling arm 15 of the terminal holder 10 is, for example, arc-shaped, and a pair of tabs 16, 16 projecting outwardly is formed on the outer surface of the coupling arm 15.

In the present embodiment, due to the structure of the connector housing and the terminal to which the terminal holder 10 is fitted, the arrangements of the locking arms 11, 11, the coupling arm 15, the first locking portions 12, the second locking portions 13, and the tabs 16, 16 of the terminal holder 10 are in a symmetrical configuration as shown in FIG. 1.

In addition, due to a restriction of an insertion space into which the terminal holder 10 is inserted, the terminal holder 10 is generally a flat sheet-like structure as a whole.

Figure 2A:
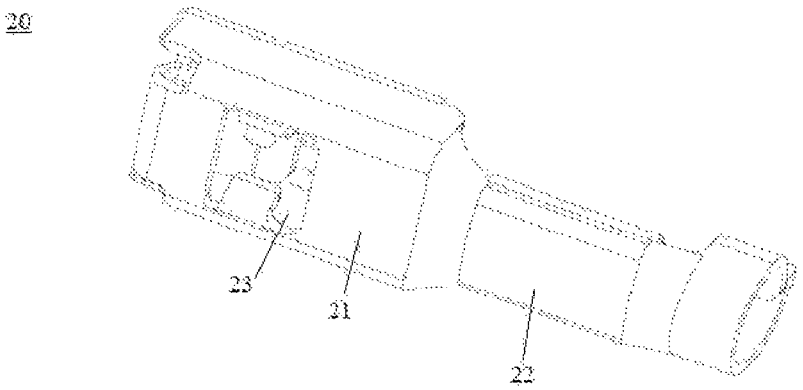
FIG. 2A is a perspective view.
Figure 2B:
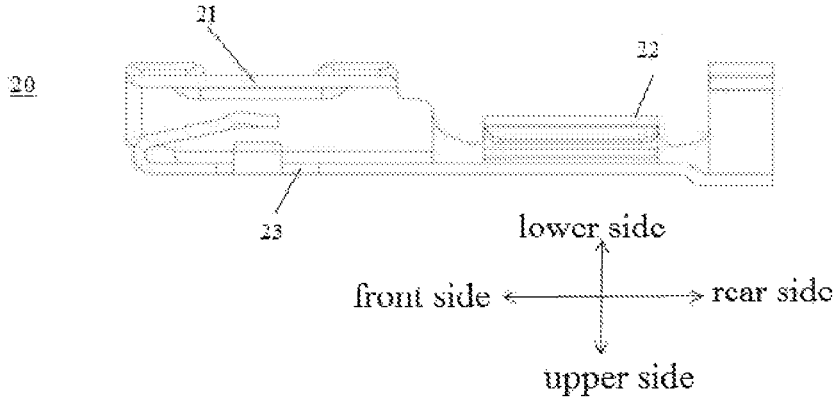
FIG. 2B is a longitudinal cross-sectional view.
Figure 2C:
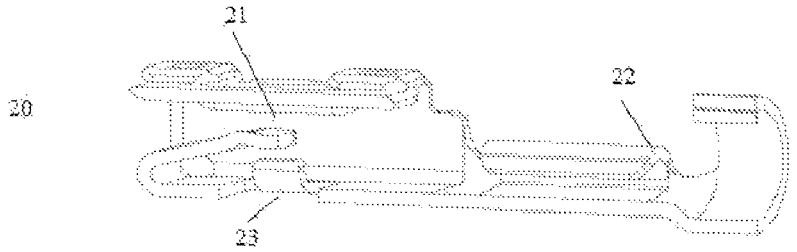
FIG. 2C is a perspective view of FIG. 2B.

The structure of a terminal according to the present embodiment will be described below with reference to FIG. 2. FIG. 2A is a perspective view of the terminal 20, FIG. 2B is a longitudinal cross-sectional view and FIG. 2C is a perspective view of FIG. 2B. A terminal according to the present embodiment is a typical female terminal 20 that includes an electrical connection portion 21 with, for example, a rectangular cylindrical shape provided on a front side to be electrically connected with a mating male terminal, and a crimping portion 22 which is provided on the rear side to crimp the electric wire. The electrical connection portion 21 of the terminal 20 includes a retaining hole 23 for retaining with a lance 33 in a terminal accommodating chamber 31 of a connector housing 30 described later.

The connector housing 30 according to the present embodiment is a typical connector housing that includes one or more terminal accommodating chambers 31 for inserting and accommodating the terminal 20, as shown in FIGS. 3 and 4. The terminal accommodating chamber 31 is also used for inserting and accommodating the terminal holder 10. Specifically, the terminal accommodating chamber 31 includes an opening (an insertion opening) at one side, and both of the terminal holder 10 and the mating male terminal are inserted from the opening at the one side into the terminal accommodating chamber 31, and the terminal 20 is inserted from an opposite opening at the other side. In other words, the accommodation space inside the terminal accommodation chamber 31 is divided into a main first space for accommodating the terminal 20 and a second space adjacent to the first space for accommodating the terminal holder 10.

A lance 33 in a form of a cantilever overhung toward an opening (an insertion opening) of the terminal accommodating chamber 31 into which the terminal holder 10 is inserted is provided on an inner wall surface of an upper wall on the upper side of the terminal accommodating chamber 31 of the connector housing 30, and the lance 33 is provided with a retaining projection 34 at the free end which is, for example, a projection that projects toward the inside of the terminal accommodating chamber 31. When the terminal 20 is in a state of being fully inserted into the terminal accommodating chamber 31, the retaining projection 34 at the free end of the lance 33 is retained into the retaining hole 23 of the terminal 20 so that the terminal 20 is locked to the connector housing 30. The inner wall surfaces of the side walls on the opposite left and right sides of the terminal accommodating chamber 31 of the connector housing 30 are formed with locking protrusions 35 projecting toward the inside of the terminal accommodating chamber 31 as mating locking portion. The locking protrusions 35 are more located on the side of the insertion opening than the lance, and can be at or near the insertion opening end.

The structures of the terminal holder 10, the terminal 20, and the connector housing 30 are described above. The relationship between the terminal holder 10 with the terminal 20 and the connector housing 30 will be described below with reference to FIGS. 3-5. In practice, the terminal holder 10 is inserted in a space between the inner wall surface of the upper wall of the terminal accommodating chamber 31 of the connector housing 30 and the lance 33 and can be locked in the space. The terminal holder 10 has a temporary locking position and a final locking position. At the temporary locking position of the terminal holder 10, the terminal 20 is not inserted into a final position and the lance 33 is elastically deformable. At the final locking position of the terminal holder 10, the terminal 20 is located at the final position, the retaining projection 34 at the free end of the lance 33 is retained into the retaining hole 23 of the terminal 20, and the terminal holder 10 interferes with the lance 33 so that the lance 33 is not elastically deformable.

FIG. 3 is a view showing the terminal holder 10 is inserted in the terminal accommodating chamber 31 of the connector housing 30 according to the embodiment of present disclosure, and showing a state that the terminal holder 10 is in a temporary locking position, wherein FIG. 3A shows a side view of the longitudinally sectioned state, FIG. 3B is a perspective view of FIG. 3A in which the terminal is omitted. FIG. 4 is a cross-sectional perspective view of the state shown in FIG. 3 when viewing the interior of the terminal accommodating chamber from a direction perpendicular to a plane of the terminal holder.

As shown in FIGS. 3 and 4, before the terminal 20 is fully inserted into the terminal accommodating chamber 31, the terminal holder 10 is installed in the terminal accommodating chamber 31 in a temporary locked state beforehand. In the temporary locked state of the terminal holder 10, the terminal holder 10 is temporarily locked in the terminal accommodating chamber 31 and will not fall out of the terminal accommodating chamber 31, and at the same time, the terminal holder 10 does not interfere with the lance 33 in the terminal accommodating chamber 31, that is, it does not apply any force on the lance 33, so that the lance 33 is still in a free state. Therefore, in the temporary locked state of the terminal holder 10, the insertion of the terminal 20 into the terminal accommodating chamber 31 is not hindered.

More specifically, the terminal holder 10 is inserted into the space between the upper wall and the lance 33 of the terminal accommodating chamber from an end portion of the terminal holder 10 where the first locking portions 12 is located, that is, said end portion is an insertion start end portion. At the start of the insertion, the first locking portions 12 of the terminal holder 10 abut against the locking protrusions 35 on the left and right sidewalls of the terminal accommodating chamber 31, respectively. At this time, the locking arms 11, 11 of the terminal holder 10 are subjected to the pressing force applied by the locking protrusions 35, 35 from both sides so as to move in a direction close to each other. Since the supporting arm 14 is provided with the S-shaped elastic portion, the supporting arm 14 is able to absorb the above pressing force, so that the locking arms 11, 11 of the terminal holder 10 can easily move close to each other without making the supporting arm 14 undesirably broken due to the pressing force, and at the same time, it is advantageous to reduce the insertion force of the insertion terminal holder 10.

As the terminal holder 10 is further inserted inward, the first locking portions 12 of the terminal holder 10 pass over the locking protrusions 35 of the terminal accommodating chamber 31. Then, the supporting arm 14 of the terminal holder 10 is elastically restored and the locking arms 11, 11 are returned accordingly, and the locking protrusions 35 of the terminal accommodating chamber 31 are exactly retained between the first locking portions 12 and the second locking portions 13 of the terminal holder 10 so that a disengagement of the terminal holder 10 from the terminal accommodating chamber 31 is prevented.

Specifically, as shown in FIG. 4, in order to make it easy to insert the terminal holder 10, inclined surfaces may be provided at an insertion front end of each first locking portion 12 of the terminal holder 10 and at an corresponding insertion front end of each locking protrusion 35 of the terminal accommodating chamber 31, so that the corresponding two inclined surfaces can come into contact with each other at first and slide on each other when the terminal holder 10 is inserted, which helps to reduce the insertion force. Similarly, an inclined surface may also be provided at an insertion front end of each second locking portion 13 of the terminal holder 10, as shown in FIG. 4. On the other hand, an insertion rear end of each first locking portion 12 of the terminal holder 10 and a corresponding insertion rear end of each locking protrusion 35 of the terminal accommodating chamber 31 are, for example, surfaces perpendicular to the insertion direction respectively, as shown in FIG. 4, and thus a movement of the terminal holder 10 in an opposite direction from the insertion direction is restricted by the surface contact between the above two surfaces, but this is just an example, and the two surfaces may also be inclined surfaces that would interlock with each other.

In the temporary locked state that the terminal holder 10 described above is temporarily locked in the terminal accommodating chamber 31 of the connector housing 30, the connector housing 30 may be transported to a site where the terminal needs to be installed, and subsequent installation operations of the terminals may be performed at the site according to the individualized requirements. Since the terminal holder 10 includes the supporting arm 14, the strength and rigidity of the overall terminal holder is improved. Since the supporting arm 14 includes the S-shaped elastic portion, the pressing force exerted on the locking arms 11, 11 of the terminal holder 10 due to the pressing action during insertion can be absorbed by the supporting arm 14 while without making the supporting arm 14 broken due to the pressing force. Since the first locking portions 12 and the second locking portions 13 of the terminal holder 10 are retained with the locking protrusions 35 of the terminal accommodating chamber 31 of the connector housing 30, the terminal holder 10 is hardly to be disengaged from the connector housing 30. In addition, because of the arrangement of the supporting arm 14, the retaining force between the terminal holder 10 and the connector housing 30 can also be further increased and the terminal holder 10 is further prevented from being disengaged from the connector housing.

Figure 5A:
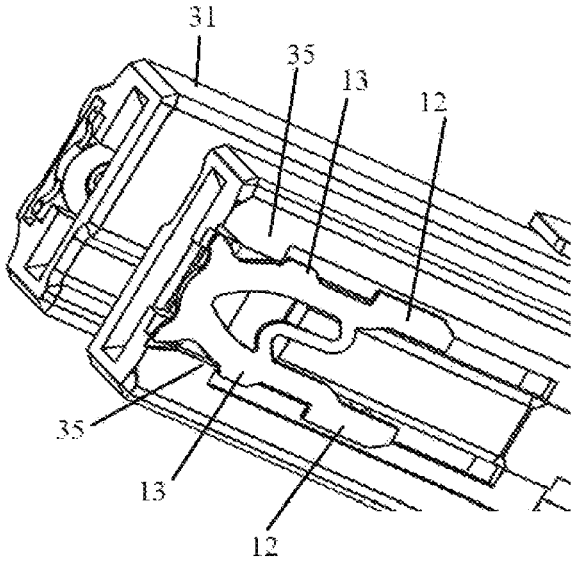
FIG. 5A shows a cross-sectional perspective view when viewing the interior of the terminal accommodating chamber from a direction perpendicular to a plane of the terminal holder.
Figure 5B:
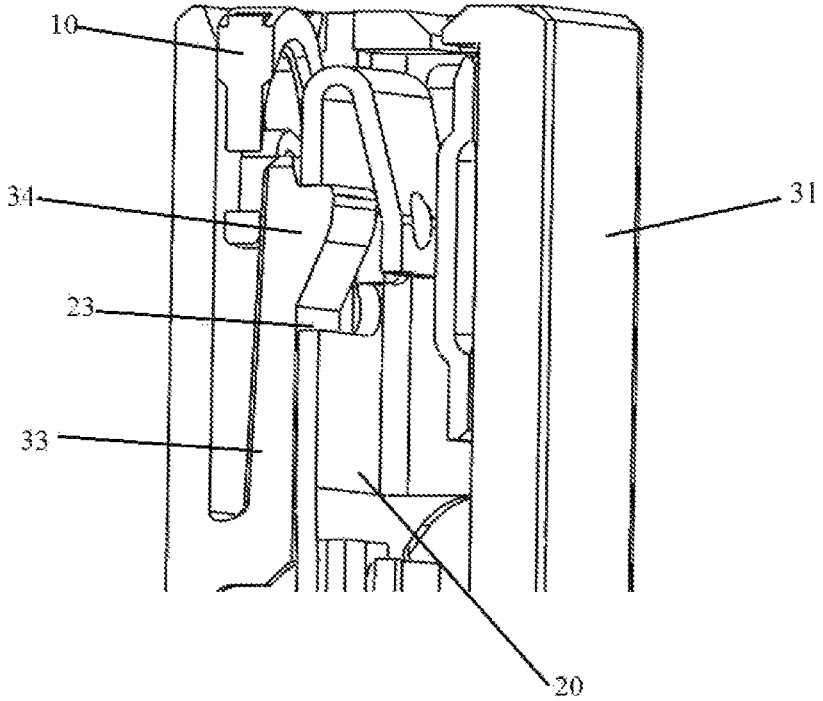
FIG. 5B shows a side perspective view in a longitudinally sectioned state.

FIG. 5 is a view showing that the terminal holder 10 has been inserted in the terminal accommodating chamber 31 of the connector housing 30 according to the embodiment of present disclosure, and showing a state that the terminal holder 10 is at the final locking position, wherein FIG. 5A shows a cross-sectional perspective view when viewing the interior of the terminal accommodating chamber from a direction perpendicular to a plane of the terminal holder 10; FIG. 5B shows a side perspective view in a longitudinally sectioned state.

When the terminal 20 is to be installed in the state shown in FIG. 4, the terminal 20 is inserted into the terminal accommodating chamber 31 of the connector housing 20 from an opening in the opposite side of the opening for inserting the terminal holder 10. As the insertion of the terminal 20 is proceeding, the electrical connection portion 21 of the terminal 20 contacts the lance 33 in the terminal accommodating chamber 31 of the connector housing 30 so that the lance 33 is elastically deformed. When the terminal 20 continues to be inserted up to the final position, the retaining projection 34 at the free end of the lance 33 enters into and retains with the retaining hole 23 of the terminal 20, and the lance 33 is elastically restored. At this time, with the retaining between the lance 33 (more specifically, the retaining projection 34) disposed in the terminal accommodating chamber 31 of the connector housing 30 and the retaining hole 23 of the terminal 20, a preliminary locking of the terminal 20 is achieved, thereby preventing the terminal 20 from being disengaged from the terminal accommodating chamber 31 of the connector housing 30.

However, in the preliminary locking state of the terminal 20, since the lance 33 may be displaced due to vibration or the like, which would cause the retaining projection 34 of the lance 33 to be disengaged from the retaining hole 23 of the terminal 20, there is a possibility that the terminal 20 is disengaged from the terminal accommodating chamber 31 of the connector housing 30. In order to prevent the above situation from happening, after the preliminary locking of the terminal 20, that is, after the terminal is in the final position, the terminal holder 10 in the temporary locking position may be further inserted inwardly, thereby achieving double locking of the terminal 20.

Specifically, the terminal holder 10 is further inserted into the space between the upper wall 32 and the lance 33 of the terminal accommodating chamber 31 of the connector housing 30, so that the second locking portions 13 of the terminal holder 10 slide onto the locking protrusions 35 of the terminal accommodating chamber 31 of the connector housing 30. At this time, similar to the interaction between the first locking portions 12 and the locking protrusions 35, the locking arms 11, 11 of the terminal holder 10 are subjected to the pressing force exerted by the locking protrusions 35, 35 from both sides, thereby moving in the direction close to each other. Since the supporting arm 14 is provided with the S-shape elastic portion, the supporting arm 14 is able to absorb the above pressing force, so that the locking arms 11, 11 of the terminal holder 10 can easily move toward each other without making the supporting arm 14 undesirably broken due to the pressing force, and at the same time, it is advantageous to reduce the insertion force of the insertion terminal holder 10.

As the terminal holder 10 is further inserted inward, the second locking portions 13 of the terminal holder 10 pass over the locking protrusions 35 of the terminal accommodating chamber 31. Then, the supporting arm 14 of the terminal holder 10 is elastically restored and the locking arms 11, 11 are returned accordingly, and the locking protrusions 35 of the terminal accommodating chamber 31 retain with the second locking portions 13, and thus the terminal holder 10 is located at the final locking position shown in FIG. 5, thereby restricting the disengagement of the terminal holder 10 from the terminal accommodating chamber 31.

The terminal holder 10 interfere with the lance 33 of the terminal accommodating chamber 31 of the connector housing 30 at the final locking position of the terminal holder 10 shown in FIG. 5, in other words, the terminal holder 10 is located between the lance 33 and the upper wall of the terminal accommodating chamber 31 and is sandwiched therebetween, thus the displacement of the lance 33 in a direction disengaging from the retaining hole 23 is restricted by the terminal holder 10, that is, the lance 33 cannot be displaced in the direction disengaging from the retaining hole 23, thereby preventing the accidental disengagement of the terminal 20 and achieving the double locking of the terminal 20.

In the final locked state that the terminal holder 10 described above is finally locked in the terminal accommodating chamber 31 of the connector housing 30, the terminal is double locked, which avoids the accidental disengagement of the terminal 20 due to the disengagement of the lance 33 of the terminal accommodating chamber 31 of the connector housing 30 from the retaining hole 23 of the terminal 20. Moreover, since the terminal holder 10 includes the supporting arm 14, the strength and rigidity of the entire terminal holder are increased, the retention force with respect to the terminal can be further improved, and the terminal 20 can be prevented from accidental disengagement. Also, since the supporting arm 14 includes the S-shaped elastic portion, the pressing force exerted on the locking arms 11, 11 of the terminal holder 10 due to the pressing action during insertion can be absorbed by the supporting arm 14, and the supporting arm 14 will not hinder the movement of the locking arms 11, 11 and will not be broken due to the pressing force. Since the second locking portions 13 of the terminal holder 10 are retained with the locking protrusions 35 of the terminal accommodating chamber 31 of the connector housing 30, it is not easy for the terminal holder 10 to be disengaged from the connector housing 30. At the same time, because of the arrangement of the supporting arm 14, the retaining force between the terminal holder 10 and the connector housing 30 can also be further increased and the terminal holder 10 is further prevented from being disengaged from the connector housing 30.

In the present embodiment, the coupling arm 15 is arc-shaped with flexibility to facilitate the elastic deformation of the coupling arm due to the pressing force upon insertion of the terminal holder, but this is not a limitation, the coupling arm may also be linear or the like as long as the movement of the pair of locking arms 11, 11 is not hindered. In addition, in the present embodiment, a pair of tabs 16, 16 projecting outwardly can be provided on the outside surface of the arc-shaped coupling arm 15, so that the mounting direction of the terminal holder 10 can be ensured in accordance with the tabs 16 to 16 and the terminal holder 10 will not be mounted obliquely. It is obvious that the tabs 16, 16 are not limited and not essential.

Further, in the present embodiment, the temporary locking position and the final locking position of the terminal holder 10 are achieved by the locking between the two projecting locking portions consisted of (or included) the first and second locking portions 12, 13 disposed on the outside surface of each of the locking arms 11, 11 of the terminal holder 10 and the one locking protrusion (mating locking portion) 35 each provided on the inner wall surfaces of the side walls on the left and right sides of the terminal accommodating chamber 31 of the connector housing 30. However, it is not limited, for example, it is also possible to provide one locking portion similar as the locking protrusions 35 on the outside surface of the locking arm 11 of the terminal holder 10, and correspondingly provide two mating locking portions similar as the first locking portion 12 and the second locking portion 13 on the inner wall surfaces of the side walls on the left side and the right side of the terminal accommodating chamber 31 of the connector housing 30. Also, in the present embodiment, both the temporary locking and the final locking of the terminal holder 10 are achieved by a retaining lock between protrusions and protrusions, but it is not a limitation, and it can be achieved by a retaining lock between protrusions and recesses as long as the locking of the present disclosure can be achieved.

The embodiments of present disclosure has been described above in detail, according to the terminal holder of present disclosure, it is possible to switch between the temporary locking position and the final locking position, meet the individualized requirement for the installation and design of the different terminals, and achieve the double locking of the terminal, thus the retention force of the terminal is improved, and the terminal can be prevented from accidental disengagement from the connector housing. The terminal holder of the present disclosure includes a supporting arm that connects inside surfaces of a pair of locking arms facing each other so that the strength and rigidity of the entire terminal holder is improved, and that plays a role of supporting in the transportation process of the connector housing, and enhances the retaining force with the connector housing and the retention force with respect to the terminal. The supporting arm of the terminal holder of the present disclosure comprises an elastic portion which is capable of absorbing a pressing force so as to deform, so that the supporting arm will not be broken even when the terminal holder is subjected to twice pressing force during the installation to the connector housing, which improves the reliability. Moreover, even if the terminal holder is subjected to twice compression deformation during installation, the requirement for compressibility and resilience of the material is reduced due to the fact that the absorption of the force for compressional deformation is structurally realized by the supporting arm with the elastic portion, so that the freedom of material selection can be improved.

It will be apparent to those skilled in the art that the above-described embodiments are merely examples and are not intended to be limited, where the shapes, structures, and materials of the various components are not limited thereto, and those are within the scope of the present disclosure so long as the corresponding functions can be implemented.

The present disclosure is mainly characterized by the following aspects.

[1] A terminal holder (10) to be inserted into a connector housing (30) characterized in that the terminal holder (10) comprising: a pair of locking arms (11, 11) facing each other; a coupling arm (15) connecting one ends of the pair of locking arms (11, 11) opposite to each other; and a supporting arm (14) connecting inner surfaces of the pair of locking arms (11, 11) facing each other, wherein a locking portion is provided on an outer surface of each of the pair of locking arms (11, 11) opposite to the inner surface.

[2] The terminal holder (10) according to [1] characterized in that, the locking portion comprises a first locking portion (12) and a second locking portion (13) that are protruded from the outer surface and are separately provided from each other, the first locking portion (12) is arranged on a side of the other end of the locking arm, and the second locking portion is arranged on a side of the coupling arm (15) with respect to the first locking portion.

[3] The terminal holder (10) according to [2] characterized in that, the supporting arm (14) includes an elastic portion with which the pair of locking arms (11, 11) is movable in a direction close to each other and in a direction away from each other.

[4] The terminal holder (10) according to [3] characterized in that the elastic portion is one of an S-shaped portion, a wavy portion and an arc portion formed in the supporting arm (14).

[5] The terminal holder (10) according to any one of [2] to [4] characterized in that the first locking portions (12) are provided at the other end of the pair of locking arms (11, 11), respectively.

[6] The terminal holder (10) according to any one of [2] to [4] characterized in that the supporting arm (14) is positioned between the first locking portions (12) and the second locking portions (13).

[7] The terminal holder (10) according to any one of [1] to [4] characterized in that the coupling arm (15) of the terminal holder (10) is arc-shaped, and a pair of tabs (16, 16) projecting outwardly is formed on an outer surface of the coupling arm (15).

[8] A connector characterized in that it comprises: a connector housing; a terminal (20); and the terminal holder (10) of any of [1] to [7], wherein the connector housing (30) comprises a terminal accommodating chamber (31) in which the terminal (20) is inserted and received, and the terminal holder (10) is also inserted in the terminal accommodating chamber (31), a lance (33) in a form of a cantilever overhung toward an opening of the terminal accommodating chamber (31) for inserting the terminal holder (10) is provided on an inner wall surface of an upper wall (32) on an upper side of the terminal accommodating chamber (31) of the connector housing (30), and mating locking portions are provided on inner wall surfaces of side walls on a left side and a right side of the terminal accommodating chamber (31) of the connector housing (30) opposite to each other, the terminal (20) has a retaining hole (23), when the terminal (20) is in a state of being fully inserted into the terminal accommodating chamber (31), a retaining projection (34) at a free end of the lance (33) is retained into the retaining hole, so that the terminal (20) is locked to the connector housing (30), and the terminal holder (10) is inserted into a space between the inner wall surface of the upper wall (32) of the terminal accommodating chamber (31) of the connector housing (30) and the lance and can be locked in the space by a locking between the locking portions and the mating locking portions, and the terminal holder (10) has a temporary locking position at which the terminal (20) is not inserted to a final position and the lance (33) is elastically deformable and a final locking position at which the terminal (20) is at the final position, the retaining projection (34) of the lance (33) is retained in the retaining hole (23) and the terminal holder (10) interferes with the lance (33) so that the lance (33) cannot be elastically deformed in a direction of disengaging from the retaining hole (23).

[9] The connector according to [8] characterized in that the mating locking portions formed on the inner wall surfaces of the side walls on the left and the right sides of the terminal accommodating chamber (31) of the connector housing (30) are locking protrusions protruding inwardly, the locking portions formed on the outside surfaces of each of the locking arms (11, 11) of the terminal holder (10) has a first locking portion (12) and a second locking portion (13) which are protruded from the outside surface and are separately provided from each other, the first locking portions (12) is arranged on a side of the other end of the locking arms, and the second locking portion is arranged on a side of the coupling arm (15) with respect to the first locking portion, the locking protrusions are retained between the first locking portions and the second locking portions of the terminal holder at the temporary locking position of the terminal holder, and the locking protrusions are retained to the second locking portions at the final locking position of the terminal holder.

The invention claimed is:

1. A terminal holder configured to be inserted into a connector housing, wherein the terminal holder comprises:

a pair of locking arms facing each other;

a coupling arm connecting ends of the pair of locking arms opposite to each other; and a supporting arm connecting inner surfaces of the pair of locking arms facing each other, wherein a locking portion is located on an outer surface of each of the pair of locking arms opposite to the inner surface, wherein the locking portion includes a first locking portion and a second locking portion that are protruded from the outer surface and are separate from each other, the first locking portion is arranged on a side of an other end of at least one of the locking arms, and the second locking portion is arranged on a side of the coupling arm with respect to the first locking portion, and wherein the supporting arm includes an elastic portion with which the pair of locking arms is movable in a direction close to each other and in a direction away from each other.

2. The terminal holder according to claim 1, wherein the elastic portion is an S-shaped portion, a wavy portion or an arc portion formed in the supporting arm.

3. The terminal holder according to claim 1, wherein at least one first locking portion is located at the other end of the pair of locking arms.

4. The terminal holder according to claim 1, wherein the supporting arm is positioned between the first locking portion and the second locking portion.

5. The terminal holder according to claim 1, wherein the coupling arm of the terminal holder is arc-shaped, and a pair of tabs projecting outwardly is formed on an outer surface of the coupling arm.

6. A connector, comprising:

a connector housing;

a terminal; and the terminal holder according to claim 1, wherein the connector housing includes a terminal accommodating chamber in which the terminal is configured to be inserted and received, and the terminal holder is configured to be inserted in the terminal accommodating chamber, a lance in a form of a cantilever overhung toward an opening of the terminal accommodating chamber for inserting the terminal holder is located on an inner wall surface of an upper wall on an upper side of the terminal accommodating chamber of the connector housing, and mating locking portions are located on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at a free end of the lance is retained into the retaining hole, so that the terminal is locked to the connector housing, and the terminal holder is inserted into a space between the inner wall surface of the upper wall of the terminal accommodating chamber of the connector housing and the lance and is configured to be locked in the space by a locking between the locking portions and the mating locking portions, and the terminal holder has a temporary locking position and a final locking position, and at the temporary locking position of the terminal holder, the terminal is not inserted to a final position and the lance is elastically deformable; and at the final locking position of the terminal holder, the terminal is at the final position, the retaining projection of the lance is retained in the retaining hole, and the terminal holder interferes with the lance, so that the lance cannot be elastically deformed in a direction of disengaging from the retaining hole.

7. The connector according to claim 6, wherein the mating locking portions formed on the inner wall surfaces of the side walls on the left and right sides of the terminal accommodating chamber of the connector housing opposite to each other are locking protrusions protruding towards an inside of the terminal accommodating chamber, the locking portion formed on the outside surface of each of the locking arms of the terminal holder has a first locking portion and a second locking portion which are protruded from the outside surface and are separate from each other, the first locking portion is arranged on a side of an other end of the locking arm, and the second locking portion is arranged on a side of the coupling arm with respect to the first locking portion, the locking protrusions are retained between first locking portions and second locking portions of the terminal holder at the temporary locking position of the terminal holder, and the locking protrusions are retained to the second locking portions at the final locking position of the terminal holder.

8. A connector, comprising:

a connector housing;

a terminal; and the terminal holder according to claim 2, wherein the connector housing includes a terminal accommodating chamber in which the terminal is configured to be inserted and received, and the terminal holder is configured to be inserted in the terminal accommodating chamber, a lance in a form of a cantilever overhung toward an opening of the terminal accommodating chamber for inserting the terminal holder is located on an inner wall surface of an upper wall on an upper side of the terminal accommodating chamber of the connector housing, and mating locking portions are located on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at a free end of the lance is retained into the retaining hole, so that the terminal is locked to the connector housing, and the terminal holder is inserted into a space between the inner wall surface of the upper wall of the terminal accommodating chamber of the connector housing and the lance and is configured to be locked in the space by a locking between the locking portions and the mating locking portions, and the terminal holder has a temporary locking position and a final locking position, and at the temporary locking position of the terminal holder, the terminal is not inserted to a final position and the lance is elastically deformable; and at the final locking position of the terminal holder, the terminal is at the final position, the retaining projection of the lance is retained in the retaining hole, and the terminal holder interferes with the lance, so that the lance cannot be elastically deformed in a direction of disengaging from the retaining hole.

9. The connector according to claim 8, wherein the mating locking portions formed on the inner wall surfaces of the side walls on the left and right sides of the terminal accommodating chamber of the connector housing opposite to each other are locking protrusions protruding towards an inside of the terminal accommodating chamber, the locking protrusions are retained between the first locking portions and the second locking portions of the terminal holder at the temporary locking position of the terminal holder, and the locking protrusions are retained to the second locking portions at the final locking position of the terminal holder.

10. A connector, comprising:

a connector housing;

a terminal; and the terminal holder according to claim 3, wherein the connector housing includes a terminal accommodating chamber in which the terminal is configured to be inserted and received, and the terminal holder is configured to be inserted in the terminal accommodating chamber, a lance in a form of a cantilever overhung toward an opening of the terminal accommodating chamber for inserting the terminal holder is located on an inner wall surface of an upper wall on an upper side of the terminal accommodating chamber of the connector housing, and mating locking portions are located on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at a free end of the lance is retained into the retaining hole, so that the terminal is locked to the connector housing, and the terminal holder is inserted into a space between the inner wall surface of the upper wall of the terminal accommodating chamber of the connector housing and the lance and is configured to be locked in the space by a locking between the locking portions and the mating locking portions, and the terminal holder has a temporary locking position and a final locking position, and at the temporary locking position of the terminal holder, the terminal is not inserted to a final position and the lance is elastically deformable; and at the final locking position of the terminal holder, the terminal is at the final position, the retaining projection of the lance is retained in the retaining hole, and the terminal holder interferes with the lance, so that the lance cannot be elastically deformed in a direction of disengaging from the retaining hole.

11. The connector according to claim 10, wherein the mating locking portions formed on the inner wall surfaces of the side walls on the left and right sides of the terminal accommodating chamber of the connector housing opposite to each other are locking protrusions protruding towards an inside of the terminal accommodating chamber, the locking protrusions are retained between the first locking portions and the second locking portions of the terminal holder at the temporary locking position of the terminal holder, and the locking protrusions are retained to the second locking portions at the final locking position of the terminal holder.

12. A connector, comprising:

a connector housing;

a terminal; and the terminal holder according to claim 4, wherein the connector housing includes a terminal accommodating chamber in which the terminal is configured to be inserted and received, and the terminal holder is configured to be inserted in the terminal accommodating chamber, a lance in a form of a cantilever overhung toward an opening of the terminal accommodating chamber for inserting the terminal holder is located on an inner wall surface of an upper wall on an upper side of the terminal accommodating chamber of the connector housing, and mating locking portions are located on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at a free end of the lance is retained into the retaining hole, so that the terminal is locked to the connector housing, and the terminal holder is inserted into a space between the inner wall surface of the upper wall of the terminal accommodating chamber of the connector housing and the lance and is configured to be locked in the space by a locking between the locking portions and the mating locking portions, and the terminal holder has a temporary locking position and a final locking position, and at the temporary locking position of the terminal holder, the terminal is not inserted to a final position and the lance is elastically deformable; and at the final locking position of the terminal holder, the terminal is at the final position, the retaining projection of the lance is retained in the retaining hole, and the terminal holder interferes with the lance, so that the lance cannot be elastically deformed in a direction of disengaging from the retaining hole.

13. A connector, comprising:

a connector housing;

a terminal; and the terminal holder according to claim 5, wherein the connector housing includes a terminal accommodating chamber in which the terminal is configured to be inserted and received, and the terminal holder is configured to be inserted in the terminal accommodating chamber, a lance in a form of a cantilever overhung toward an opening of the terminal accommodating chamber for inserting the terminal holder is located on an inner wall surface of an upper wall on an upper side of the terminal accommodating chamber of the connector housing, and mating locking portions are located on inner wall surfaces of side walls on a left side and a right side of the terminal accommodating chamber of the connector housing opposite to each other, the terminal has a retaining hole, when the terminal is in a state of being fully inserted into the terminal accommodating chamber, a retaining projection at a free end of the lance is retained into the retaining hole, so that the terminal is locked to the connector housing, and the terminal holder is inserted into a space between the inner wall surface of the upper wall of the terminal accommodating chamber of the connector housing and the lance and is configured to be locked in the space by a locking between the locking portions and the mating locking portions, and the terminal holder has a temporary locking position and a final locking position, and at the temporary locking position of the terminal holder, the terminal is not inserted to a final position and the lance is elastically deformable; and at the final locking position of the terminal holder, the terminal is at the final position, the retaining projection of the lance is retained in the retaining hole, and the terminal holder interferes with the lance, so that the lance cannot be elastically deformed in a direction of disengaging from the retaining hole.

14. The connector according to claim 13, wherein the mating locking portions formed on the inner wall surfaces of the side walls on the left and right sides of the terminal accommodating chamber of the connector housing opposite to each other are locking protrusions protruding towards an inside of the terminal accommodating chamber, the locking portion formed on the outside surface of each of the locking arms of the terminal holder has a first locking portion and a second locking portion which are protruded from the outside surface and are separate from each other, the first locking portion is arranged on a side of the other end of the locking arm, and the second locking portion is arranged on a side of the coupling arm with respect to the first locking portion, the locking protrusions are retained between the first locking portions and the second locking portions of the terminal holder at the temporary locking position of the terminal holder, and the locking protrusions are retained to the second locking portions at the final locking position of the terminal holder.

* * * * *